United States Patent [19]

Morris et al.

[11] 4,398,722

[45] Aug. 16, 1983

[54] LASER BEAM TARGET

[75] Inventors: James F. Morris, Apopka; Roland Pittman, Casselberry, both of Fla.

[73] Assignee: International Laser Systems, Inc., Orlando, Fla.

[21] Appl. No.: 360,479

[22] Filed: Mar. 22, 1982

[51] Int. Cl.[3] ..... F41J 5/02

[52] U.S. Cl. ..... 273/310; 434/22

[58] Field of Search ..... 273/310, 311, 312, 371; 434/22

[56] References Cited

U.S. PATENT DOCUMENTS

| | | | |
|---|---|---|---|
| 3,034,788 | 5/1962 | Cauble | 273/371 X |
| 3,526,972 | 9/1970 | Sumpf | 273/310 X |
| 4,086,711 | 5/1978 | Gammarino | 273/310 X |
| 4,102,059 | 7/1978 | Kimble | 273/310 X |
| 4,299,393 | 11/1981 | Benckert | 273/310 |

FOREIGN PATENT DOCUMENTS

| | | | |
|---|---|---|---|
| 1598566 | 9/1981 | United Kingdom | 273/371 |

*Primary Examiner*—Harland S. Skogquist

*Attorney, Agent, or Firm*—William M. Hobby, III

[57] ABSTRACT

A laser weapon simulator target apparatus is provided having a conventional target formed of a material translucent to a laser wavelength and a laser radiation detector positioned behind the target on one end portion thereof and facing in a generally parallel direction to the back of the target so that scattered radiation from a laser beam penetrating the target will be received by the radiation detector to indicate a laser beam hitting the target. The target may have a back enclosure to prevent radiation that misses the target being reflected back onto the detector. The target allows a single laser radiation detector to be utilized and at the same time allows the target to be used for live rounds or with a laser weapon simulator without changing the target.

15 Claims, 3 Drawing Figures

LASER BEAM TARGET

BACKGROUND OF THE INVENTION

The present invention relates to targets and especially to a target for measuring a hit with a laser weapon simulator which can be utilized in a dual role as a live fire target or a laser beam area target.

In the past, it has been common to use a wide variety of targets for military and police training. The targets are typically made of polymer material with either a flat surface or a three dimensional target and may be coated on one side to resemble a person with a weapon. These targets are typically for live fire and whether the target is hit or missed can be determined with an impact sensor. In recent years it has been practiced to provide training with other than live fire such as utilizing a weapon which fires a laser beam rather than a live round of ammunition. To use a laser weapon simulator of this type requires a target that is sensitive to the radiation frequencies of the laser beam which might typically be an infra-red laser beam. Prior weapon simulation targets had the laser radiation detector facing the source of radiation. This leads to the problem of "effective simulation". Effective simulation requires the weapon simulator to have a beam divergence equal to the weapon dispersion. If, for example, a weapon had a one milliradium dispersion then the beam at 10 meters would have a one centimeter diameter beam. This would require the spacing between the detectors to be in the order of one centimeter, and therefore, a large number of detectors would be needed at short range. At a weapon/target range of one kilometer, however, the beam diameter would be one meter and only a few detectors would be required. Thus, close in targets would likely be different than the long range targets because of the high detector density required. The near range target would also be more costly. If the targets are different as a function of range then the range would be required to be a fixed range rather than a situation encounter range, such as a walk through with surprise target exposure. The detector being directly in the beam also eliminates the possibility of a dual function target where live round ammunition or a laser weapon simulator can be used alternatively since live rounds would likely damage the detectors. This would require a change of targets when changing from live rounds to laser beams and would prohibit simultaneous use of the range.

The present invention advantageously provides for the use of a single detector for each target which can be used at any range desired to provide effective simulation at all ranges with no adjustments and would allow the use of conventional live fire targets for laser simulation targets while providing ability of the target to function as a live ammunition target and laser target alternatively or simultaneously. The area laser radiation detector of the present invention would not alter the normal target replacement and would, thus, be cost effective and reliable.

SUMMARY OF THE INVENTION

A laser target apparatus has a target formed of a material translucent to a laser wavelength and a laser radiation detector positioned behind the target on one end portion thereof and facing in a generally parallel direction to the back of the target so that scattered radiation from a laser beam penetrating the target will be received by the radiation detector to indicate a laser beam hitting the target. The target may include a back enclosure to prevent a missed laser beam hitting another object and reflecting onto the detector. The target advantageously allows a single detector being used at any target range and the alternate use of live rounds of ammunition or a laser weapon simulator without damaging the laser radiation detector.

BRIEF DESCRIPTION OF THE DRAWINGS

Other objects, features and advantages of the present invention will be apparent from the written description and the drawings, in which.

DESCRIPTION OF THE PREFERRED EMBODIMENTS

The basic concept of the present invention is that typical live fire 3-D targets are normally made from materials that are translucent at the wavelength of a laser weapon simulator and will effectively scatter the penetrating laser beam. The target is translucent to the weapon simulator wavelength even though it appears opaque to the human eye. The property of being translucent means that some of the impinging laser beam passes through the target, but after passing through the target does not have the same definition or size in that the target material characteristically is made up of a multitude of "mie" scatterers, which scatter the radiation in all directions. This scattering property principal is fundamental to area radiation detection.

Figure 1:
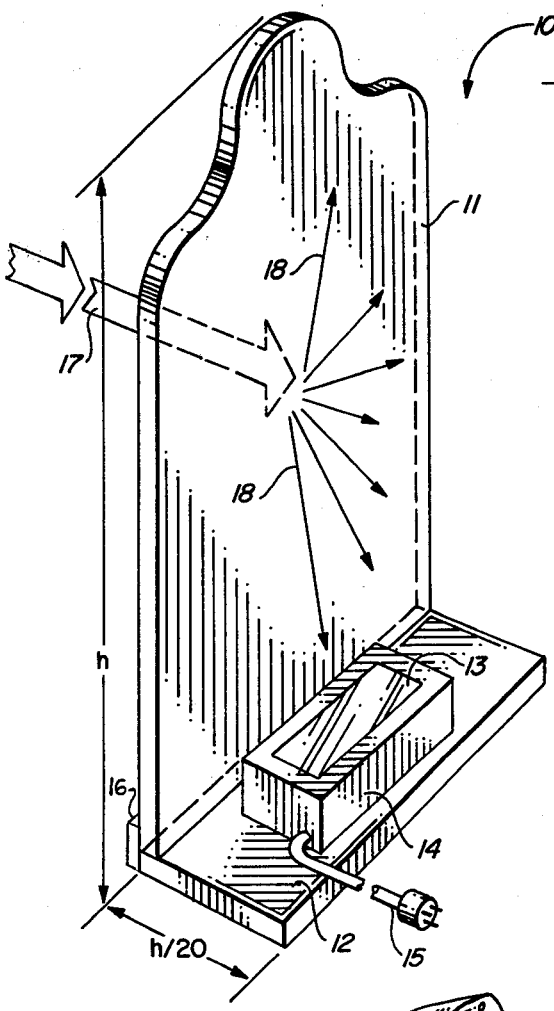
FIG. 1 is a perspective view of a target showing diagrammatically a scatter radiation pattern of a laser beam.

In FIG. 1, a target 10 in accordance with the present invention has a flat target 11 made of a polymer material which is translucent to a laser wavelength, such as an infra-red laser. These targets may be made of an acrylic or other polymer as well as foamed polymers, and may be coated on the front side to indicate an individual holding a weapon. The target 10 has a base 12 having a laser radiation detector 13 and a receiver 14 and connected by electrical cable 15 for generating a signal responsive to radiation hitting the radiation detector to indicate a hit with a laser beam. This type of target is normally connected to a target mechanism mounted below the target which has a two inch steel band 16 protruding up for supporting the target to the target mechanism. This standard installation advantageously provides protection for the radiation detector 14. In operation, a radiation beam shown as 17 from a laser weapon simulator hits the target panel 11 producing a mie scattering 18 on the backside of the target, a small part of which scattered energy 18 will hit the radiation receiver 14 detector 13. The radiation detector is mounted behind the target panel 11 with its rear surface a distance of the height of the target 11 divided by twenty (H/20 or between H/2 and H/40) so that the detector 14 is not too close to the target to miss the scatter radiation 18. If the laser beam misses the target material 11, no hit is recorded by the laser detector 14. However, other objects such as trees or other object might reflect radiation to hit the laser detector surface 13. This situation is overcome by the embodiment shown in FIGS. 2 and 3.

Figure 2:
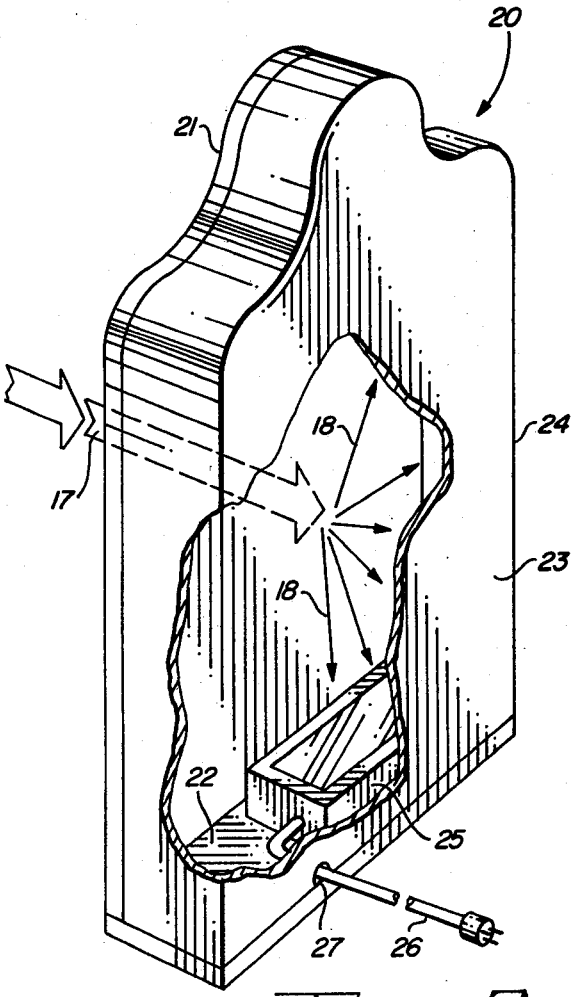
FIG. 2 is a perspective view of a target in accordance with FIG. 1 having the back enclosure.

Turning now to FIG. 2, target 20 has a front panel 21 illustrated a form of a flat panel which is made of a material translucent to a laser wavelength such as an infra-red laser and which may be coated on it's surface. A base 22 which may also be a component of the target mechanism arm may be attached to a rear enclosure wall 23 and side enclosure walls 24 may be shaped the same as the outline of the front panel 21. A laser radiation detector 25 is mounted to the base 22 and has a cable 26 extending therefrom to an opening 27 in the back panel 23. A laser beam 17 hitting the panel 21 produces the mie scatter 18 which scatters in all directions, a portion of which will hit the laser detector 25. The back 24 may be made of any material desired, including a material having a good specular reflector, a good diffused reflector, or a good absorber; all of which give good performance and is not critical to the operation of the invention. A good diffused reflective surface in preliminary tests appeared to provide slightly better performance. In the embodiment of FIG. 2, if the laser beam 17 misses the target surface 21 and hits a nearby object, reflected energy cannot reach the laser detector 25 to indicate a hit on the target.

Figure 3:
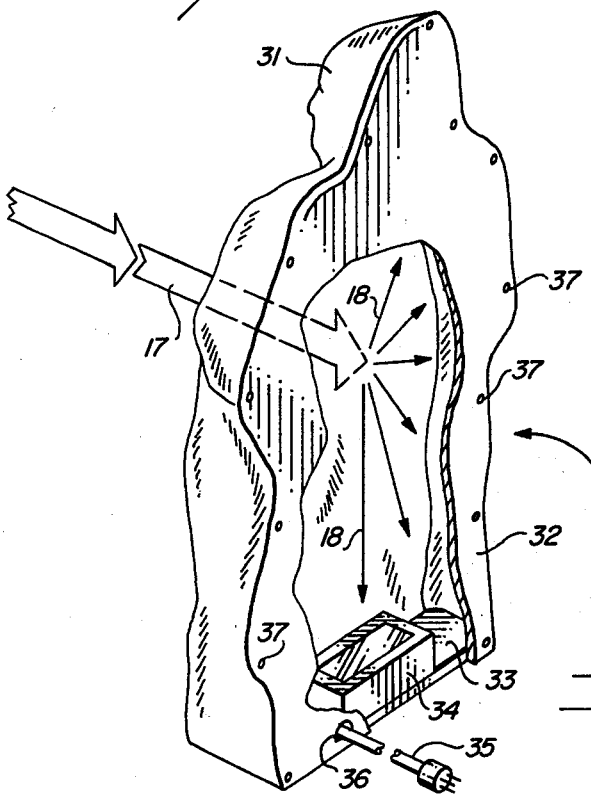
FIG. 3 is a perspective view of a three dimensional target having a portion cutaway in accordance with the present invention.

Turning to FIG. 3, a three dimensional target 30 is indicated having a three dimensional target surface 31 which is made of a material translucent to a laser wavelength, such as an infra-red laser and which may have a painted surface and shaped like an individual holding a weapon, or the like, for a more realistic looking target. The laser beam 17 is shown hitting the surface and producing scattering 18 behind the surface of the target 31. The target portion 31 is a conventional target currently in use and only requires a flat back surface 32 along with the base 33 having a detector 34 mounted slightly behind the target surface 31 and facing in a generally parallel upward direction with the back of the target and spaced a short distance behind the front surface of the target 31. The detector 34 is attached to the base 31 and has it's electrical cable 35 passing through an opening 36 out the opaque back enclosure 32. The opaque back enclosure may be attached to the target 31 in any manner desired, such as with screws 37 which may be attached onto small angled clips onto a flanged surface of the target material 31. In 3-D targets, as in the flat panel targets, mounting is by attaching a base of a 3-D target to a two inch steel band on the target mechanism. This standard installation of the target and target mechanism is such that the target mechanism is protected from live rounds. This protection extends up to two inches and the radiation detector is mounted below the top of the band, and is completely protected from live rounds. Thus, the target 30 can be used with either live rounds or with a laser weapon simulator and going from one to the other only requires a single detector 34 for full coverage of the target surface 31. If the target surface 31 becomes sufficiently damaged with live rounds, it can be replaced along with the back 32, leaving the laser radiation detector 34 and base 33 in place, so that the only additional cost in changing the target is the opaque back enclosure which can be made with an inexpensive flat material.

It should be clear at this point that a target apparatus has been provided which can be used either with a laser weapon simulator or with live rounds of ammunition and requires a single laser radiation detector for any range target and which can be readily attached to existing targets, providing that the targets are of a material translucent to a laser wavelength to produce the necessary scattering. The opaque back enclosure for the targets can be made pretty much of any material desired while the laser radiation detector can be a standard pin photodiode detector and associated transimpedence, amplifier and threshold detector properly positioned behind the target and facing in a generally upward direction parallel to the vertical target. Accordingly, the present invention is not to be construed as limited to the forms shown, which are to be considered illustrative rather than restrictive.

I claim:

1. A target device comprising in combination:
   a target formed of a material translucent to a laser wavelength; and
   radiation detector means positioned behind said target on one end portion thereof and facing in a generally parallel direction to said target, whereby scattered radiation from a laser beam penetrating said target will be received by said radiation detector means to indicate a laser beam hitting said target.

2. A target device in accordance with claim 1, including a back cover located behind said target and said radiation detection means.

3. A target device in accordance with claim 1, including a back enclosure substantially enclosing said radiation detector means between said target and said back enclosure.

4. A target device in accordance with claim 2, including a target base connected to said target having said radiation detector means attached thereto.

5. A target device in accordance with claim 4, in which said base is removably connected to said target.

6. A target device in accordance with claim 5, in which said target is a three dimensional shaped target having an open back closed with a flat panel.

7. A target device in accordance with claim 6, in which a steel band is positioned in front of said radiation detector means for preventing damage to said radiation detector means.

8. A target device in accordance with claim 1, in which said radiation detector means includes a single laser radiation detector.

9. A target device in accordance with claim 3, in which said target device includes an existing live fire target having said radiation detector means and back enclosure removably attached thereto.

10. A target device in accordance with claim 1, in which said radiation detection means is positioned behind said target at the center of the base portion facing upward in a parallel to said target.

11. An attachment for a live ammunition target for converting the target to a laser weapon simulator target comprising in combination:
   a laser radiation detector adapted to be attached adjacent a live ammunition target;
   a target back enclosure for attachment to said ammunition target; and
   attaching means for attaching said back enclosure and radiation detector to said target in a manner to have said detector out of the normal line of fire of a target when mounted thereto, whereby a live fire target can be converted to a target for either live rounds or a laser weapon simulator.

12. An attachment for a live ammunition target in accordance with claim 11, in which said radiation detector is mounted behind a steel band supporting the live ammunition target to protect the radiation detector from live ammunition.

13. An attachment in accordance with claim 11, in which said radiation detector is a laser radiation detector mounted to a base and facing in a generally parallel direction to said target when attached to said target for receiving scatter radiation from a laser beam hitting said target.

14. An attachment in accordance with claim 13, in which said radiation detector is a single detector positioned in a predetermined distance behind said target adjacent the bottom of said target for receiving a scatter radiation passing through said target.

15. An attachment in accordance with claim 11, in which said radiation detector is positioned a distance behind said target bottom portion a distance approximately the height of the target divided by twenty.

* * * * *